United States Patent [19]

Ogasawara

[11] 4,239,207

[45] Dec. 16, 1980

[54] DEVICE FOR DRIVING A SIMULATED FLYING OBJECT

[75] Inventor: Toyotsugu Ogasawara, Tateishi, Japan

[73] Assignee: Tomy Kogyo Co., Ltd., Tokyo, Japan

[21] Appl. No.: 965,431

[22] Filed: Dec. 1, 1978

[30] Foreign Application Priority Data

Dec. 3, 1977 [JP] Japan ..... 52/162295[U]

[51] Int. Cl.[3] ..... A63H 27/04

[52] U.S. Cl. ..... 272/31 A

[58] Field of Search ..... 272/31 A, 31 B, 31 R

[56] References Cited

U.S. PATENT DOCUMENTS

| | | | |
|---|---|---|---|
| 1,802,139 | 4/1931 | Dacey, Jr. | 272/31 A |
| 2,159,963 | 5/1939 | Bonanno | 272/31 A |
| 2,216,899 | 10/1940 | Berger | 272/31 A |
| 2,300,649 | 11/1942 | Christiansen | 272/31 A |
| 2,426,259 | 8/1947 | Christiansen | 272/31 A |
| 2,628,095 | 2/1953 | Fields | 272/31 A |
| 2,967,706 | 1/1961 | Pettit | 272/31 A |
| 3,022,069 | 2/1962 | Pettit | 272/31 A |

FOREIGN PATENT DOCUMENTS

| | | | |
|---|---|---|---|
| 832876 | 7/1938 | France | 272/31 A |
| 1107938 | 8/1955 | France | 272/31 A |

*Primary Examiner*—Richard C. Pinkham
*Assistant Examiner*—Arnold W. Kramer
*Attorney, Agent, or Firm*—Toren, McGeady and Stanger

[57] ABSTRACT

This invention provides a device for driving a simulated flying object such as a toy aircraft, which is capable of causing the object to make a loop-the-loop flight as well as a circling flight. The device is also capable of causing the object to ascend and descend, repeatedly.

9 Claims, 10 Drawing Figures

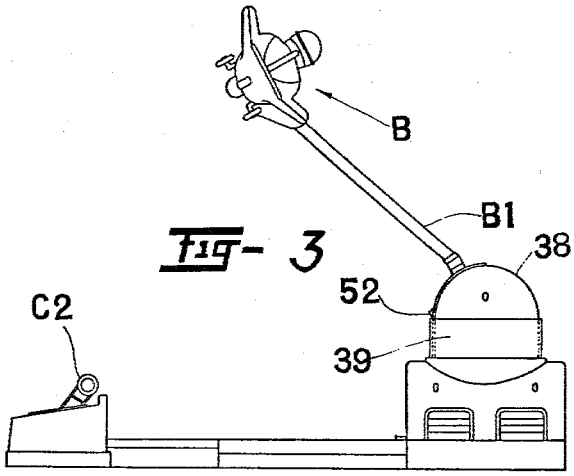
Fig- 3
Fig-4
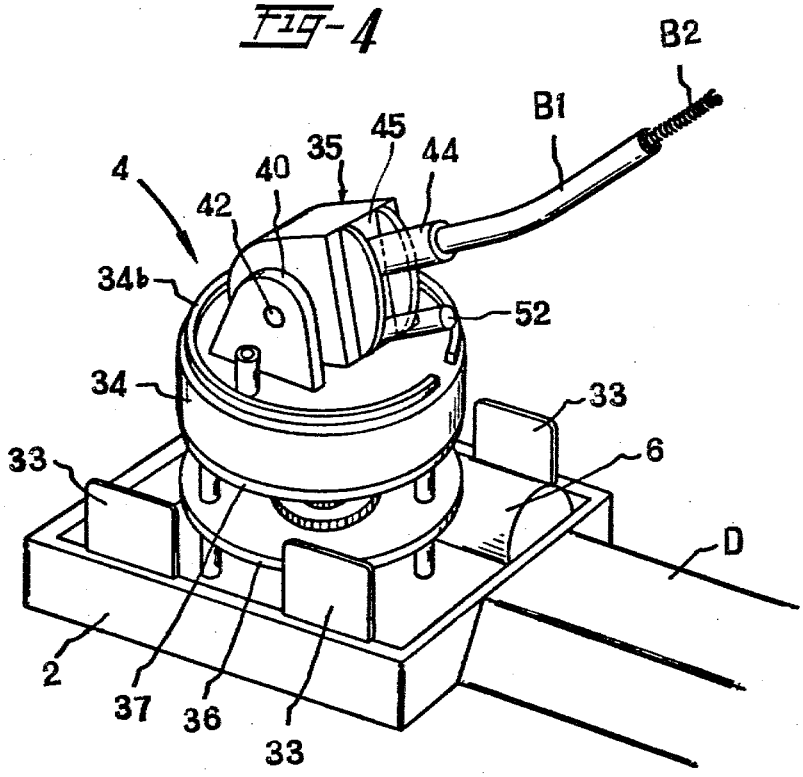

DEVICE FOR DRIVING A SIMULATED FLYING OBJECT

The present invention relates to a toy, and more particularly to a new device for driving a simulated flying object such, for example, as a toy aircraft.

It is one object of the present invention to provide a device of the kind described which is capable of causing a simulated flying object to make a loop-the-loop flight as well as a circling flight.

Another object of the invention is to provide a device of the kind described which is capable of causing a simulated flying object to ascend and descend, repeatedly.

According to the present invention, there is provided a device for driving a simulated flying object characterized in that it comprises a rotary structure including a housing, a rotator assembly rotatable relative thereto and arranged to be driven for rotation about a vertical axis, a motor mounted within said housing, a first gear for transmitting rotational power of said motor to said rotator assembly so as to rotate the latter, an elongated supporting arm rotatably supported at one end by said rotator assembly so as to be capable of being rotated therewith and relative thereto and supporting at the other end said object so that said object can be moved with said supporting arm and a second gear for transmitting rotational power of said motor to said supporting arm so as to rotate the latter relative to said rotator assembly, and manually operable control means for controlling movement of said object.

The present invention will now be described by way of example only, with reference to the accompanying drawings.

In the drawings,

FIG. 3 is an opposite side view of the variant shown in FIG. 2, illustrating the state inwhich the aircraft is making a high flying;

FIG. 4 is a perspective view of a rotator assembly of a driving gear assembly;

In the drawings, like portions or parts are designated with like reference numerals and characters.

Figure 1:
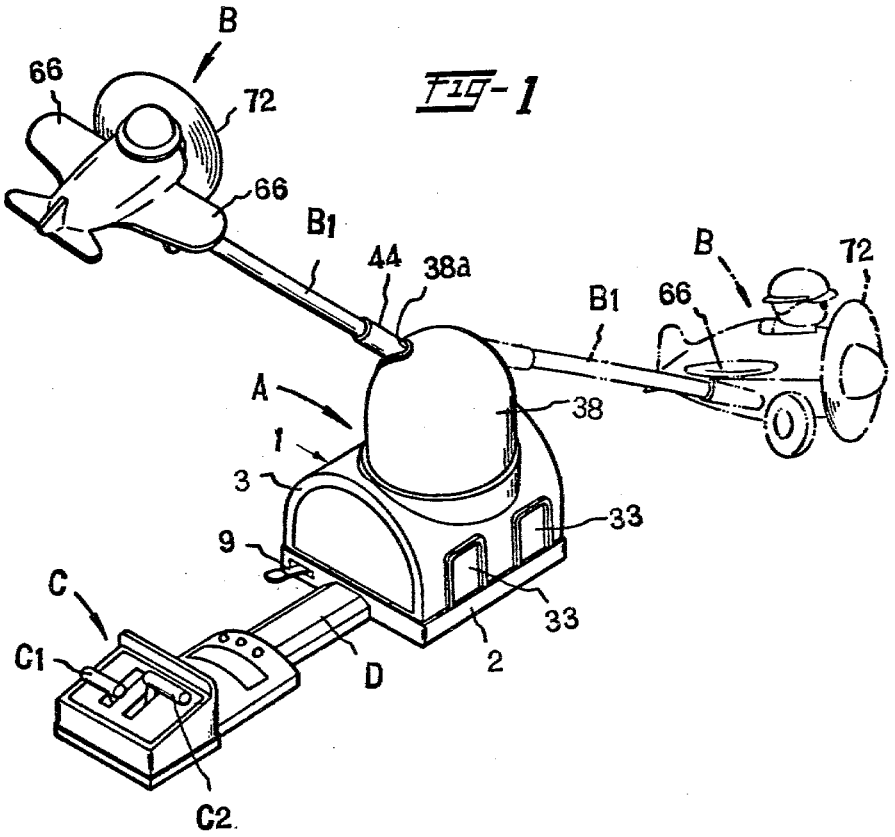
FIG. 1 is a perspective view of one embodiment of the present invention illustrating the state in which a toy aircraft is making a circling flight.

Referring now to the drawings, in FIGS. 1 to 4, A denotes a rotary structure, B denotes a toy flying object in the form of an aircraft mounted on one end of an elongated hollow supporting arm B1 the other end of which is rotatably supported by the rotary structure A and C denotes a control box which is connected to the rotary structure A by a relatively flat hollow intermediate member D, said control box C being provided with a handle lever C1 operative for actuating a motor and for causing the aircraft B to perform a loop-the-loop flight as well as a circling flight, and also with another handle lever C2 operative for causing the aircraft B to be raised and lowered.

The rotary structure A comprises a substantially semi-cylindrical housing 1 formed of a lower housing section 2 and an upper housing section 3 mounted thereon, said lower housing section 2 being integrally formed with the intermediate member D, and a driving gear assembly 4 for driving the aircraft B assembled on said lower housing section 2.

Figure 5A:
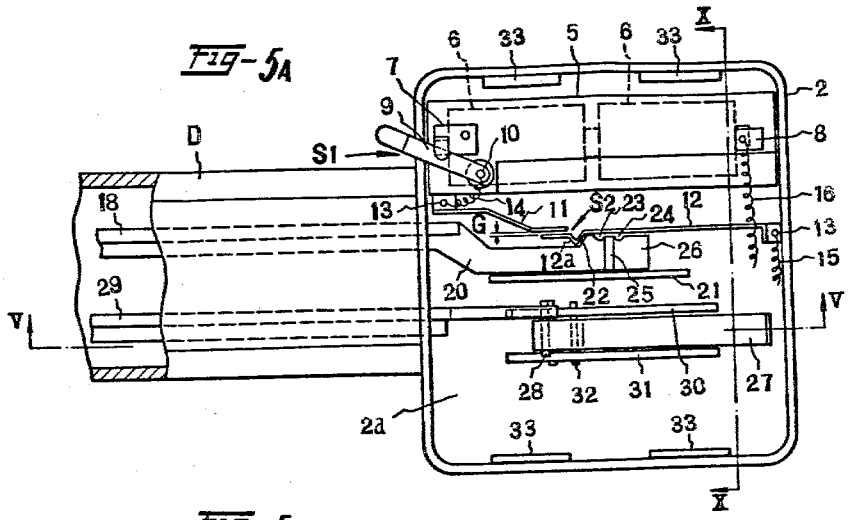
FIG. 5A is a plan view of a lower housing section.
Figure 5B:
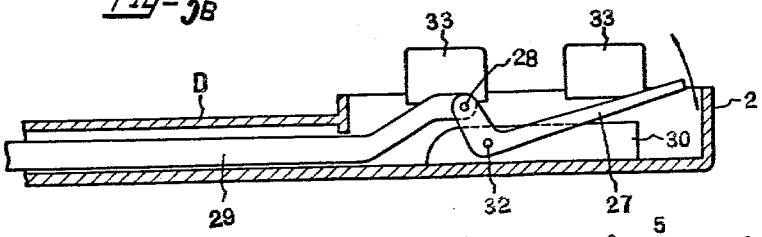
FIG. 5B is a cross-sectional view taken along the V—V line of FIG. 5A.
Figure 5C:
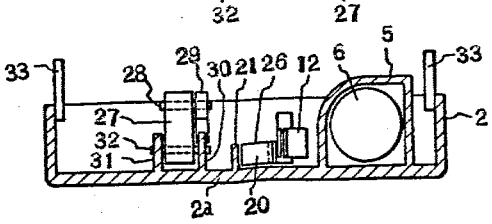
FIG. 5C is a cross-sectional view taken along the X—X line of FIG. 5A.

Referring now to FIGS. 5A, 5B and 5C, the lower housing section 2 takes the form of a substantially square tray and is provided, on one side thereof, with a casing 5 for receiving dry cells 6, 6 therein. First and second electric contacts 7, 8 are provided within said casing 5 which are adapted to be brought into contact with the positive and negative electrodes of the dry cells 6, 6 to be disposed in said casing 5 in series. Indicated by numeral 9 is a rotatable contact which is pivoted to said casing 5 by a pivot pin 10 to form a main switch S1 for the power circuit with the first contact 7 and which projects outwardly of the semi-cylindrical housing 1. Indicated by numerals 11 and 12 are first and second leaf spring contacts which form a second switch S2 for a motor circuit. The outer end of each of the spring contacts 11, 12 is securely fixed to the lower housing section 2 by means of a rivet 13. As shown, these contacts 11, 12 extend horizontally in substantially parallel relationship, leaving a certain gap G therebetween. The second spring contact 12 is provided with a V-shaped bent portion **12*a*** in the vicinity of the gap G.

The rotatable contact 7 of the main switch S1 is connected to the first spring contact 11 via a lead wire 14. Lead wires 15 and 16 extend respectively from the second spring contact 12 and said second contact 8 and are connected to an electric motor 17.

Indicated by numeral 18 is a first elongated operating rod which extends between the control box C and the lower housing section 2 through said intermediate member D and which is pivotally connected at one end to the first handle lever C1 by a pin 19 so that it can be longitudinally displaced by manipulation of the first handle lever C1. The first rod 18 is provided, at the other end portion thereof located within the lower housing section 2, with a control section 20 which is guided longitudinally along a guide wall 21 which extends upwardly from a bottom wall **2*a* of the lower housing section 2 and which extends horizontally in parallel with the control section 20 and the second spring contact 12**.

The control section 20 of the first rod 18 is provided with a lug 22 on one side thereof facing to the second spring contact 12. This lug 22 is adapted to contact and push said V-shaped portion **12*a* towards the first spring contact 11 so that by contact of the two spring contacts 11 and 12, the second switch S2 is closed. The control section 20 is also provided, on the same side as the lug 22 and between the lug 22 and the extremity of the control section 20, with first and second semi-circular notches 23 and 24 in which the apex of the V-shaped portion 12*a* is engageable. When the apex of the V-shaped portion 12*a* is in engagement with either one of these notches 23, 24, the second switch S2 for the motor circuit is kept closed. The notches 23, 24 permit the first handle lever C1 to be operated stepwise by virtue of the stopper effect which is brought about by the engagement of the V-shaped portion 12***a* with the notches 23, 24 of the control section 20. As may be seen from FIGS. 5A and 6, the control section 20 is formed with a transversely extending inclined surface 25 between the two notches 23, 24 and also with a higher flat surface 26 which extends from the upper edge of the inclined surface 25 to the extreme end of the control section 20. These surfaces 25 and 26 form a cam surface which will be described later.

Indicated by numeral 27 in FIGS. 5A to 5C and 6 is a L-shaped lever which is pivotally connected, by a pin 28, to a second elongated operating rod 29 at one end thereof which extends into the lower housing section 2 through said hollow intermediate member D. The other end of the rod 29 is pivotally connected to a link member, not shown, which in turn is pivotally connected to the second handle lever C2 of the control box C so that when this lever C2 is manipulated, the second rod 29 can be longitudinally displaced. The L-shaped lever 27 is disposed between two substantially parallel brackets 30, 31 which project upwardly from the bottom wall 2*a* of the lower housing section 2, respectively, and is rotatably supported at its bent portion by a pin 32 which extends horizontally between the brackets 30, 31. As the second rod 29 is displaced in the leftward direction as seen from the view in FIG. 5B, the tip end portion of the L-shaped lever 27 is caused to be elevated, as shown in FIG. 5B.

Numeral 33 indicates guide members which are erected along the inner faces of the side walls of the lower housing section 2. These guide members 33 serve as guides for the upper housing section 3, when the latter is mounted on the lower housing section 2.

Next, the driving gear assembly 4 will be described with reference to FIGS. 4 to 7.

The driving gear assembly 4 is mounted substantially on the central part of said lower housing section 2, and comprises a turntable 34, a vertically swingable support 35 supporting the supporting arm B1 rotatably connected thereto, said swingable support 35 being located on the upper surface of said turntable 34, two circular support plates 36, 37 having substantially the same diameter as that of said turntable 34 and being arranged one above another coaxially therewith, a dome 38 having substantially the same diameter as that of the turntable 34 and mounted thereon to cover said swingable support 35 and a tubular cylinder 39 which is so disposed as to surround the peripheries of the turntable 34 and support plates 36, 37 so that it can be vertically displaced along the common vertical axis of these members 34, 36, 37.

Figure 6:
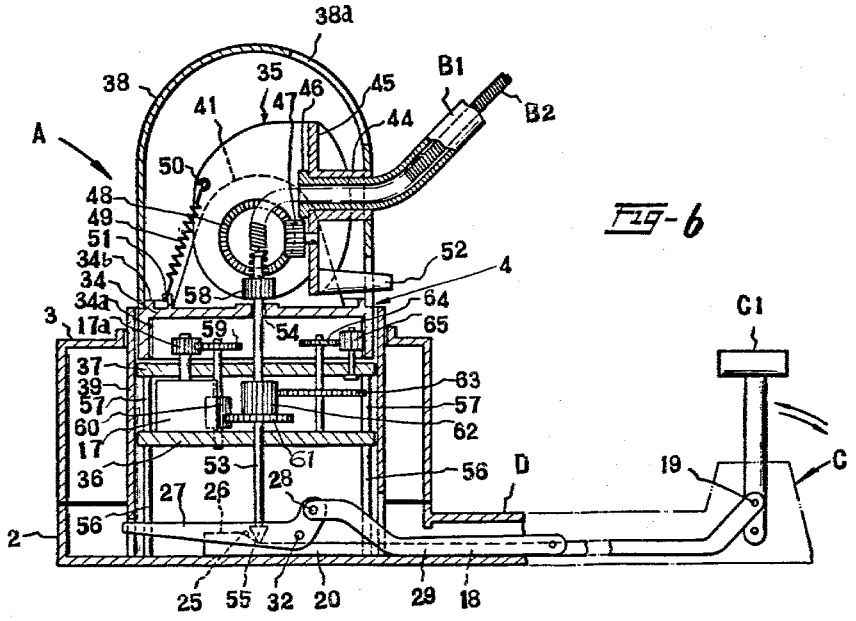
FIG. 6 is a vertical cross-sectional view of a rotary structure.

As shown in FIG. 6, the turntable 34 is substantially in the form of an inverted cup and is formed, in the inner surface of the cylindrical wall thereof, with inner gear teeth 34*a*. An annular engaging lug 34*b* protrudes upwardly from the upper surface of the turntable 34 at the portion adjacent to the peripheral edge thereof so that said dome 38 is brought into fitted engagement therewith and fixed securely onto said upper surface. On the central part of the upper surface of the turntable 34 there are also provided two upright brackets 40, 41 to receive therebetween the swingable support 35 having substantially a semi-circular shape as seen from the side view thereof. Trunnion shafts 42, 43 protrudes coaxially outwardly of side walls of said swingable support 35 and are supported by bearings provided in said brackets 40, 41 so that the swingable support 35 is swingable about a common horizontal axis of the shafts 42, 43.

Figure 7:
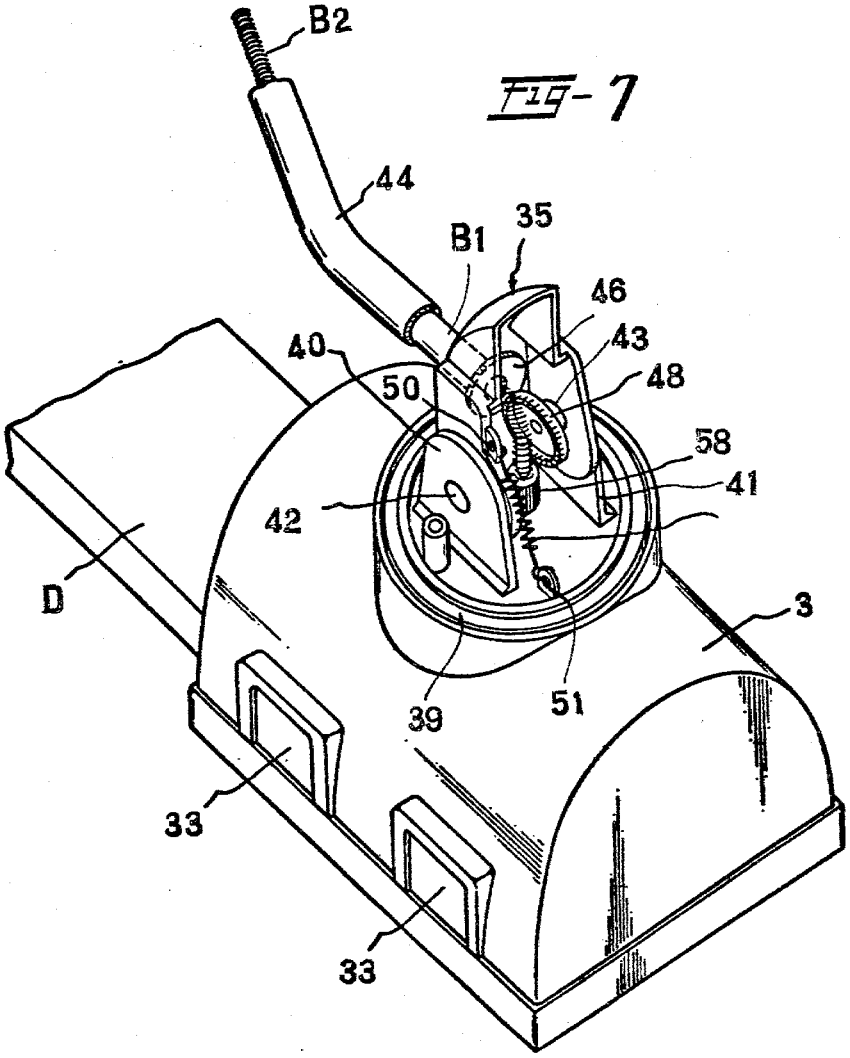
FIG. 7 is a perspective view of a rotary structure from which a dome has been removed.

As clearly shown in FIGS. 6 and 7, a slightly bent guide sleeve 44 is mounted on the supporting arm B1 in the vicinity of the base portion thereof. The supporting arm B1 projects into the swingable support 35 through a central portion of a front wall 45 thereof and is formed, at the inner end of its base portion, with a gear wheel 46 having a larger diameter than that of the supporting arm B1 and being in sliding contact with the inner surface of said front wall 45 so that the gear wheel 46 can serve also as a stopper for preventing the supporting arm B1 from coming off. The gear wheel 46 is engaged with an intermediate pinion 47 which is carried by the front wall 45 and which in turn is engaged with a crown gear 48 which is mounted coaxially with one of said trunnion shafts 43 of the swingable support 35 at the inside thereof.

As shown in FIGS. 6 and 7, there is provided a tension coil spring 49 one end of which is secured to a pin 50 provided on one of the side walls of the swingable support 35 remote from the front wall 45 thereof the other end of which spring is secured to a hook 51 projecting upwardly from the upper surface of said turntable 34. This tension spring 49 acts to bias the swingable support 35 clockwise as seen from the view in FIG. 7 so as to provide counterbalance against the weight of the aircraft B carried by the supporting arm B1. Further, there is provided a lever 52 at a lower portion of the front wall 45, which extends horizontally outwardly of the swingable support to such an extent that it protrudes slightly beyond the outer diameter of said vertically movable tubular cylinder 39. In the peripheral wall of said dome 38, there is formed a vertically elongated cutout 38*a* which enables the guide sleeve 44 and the lever 52 to be vertically swung therethrough about the horizontal axis of rotation of the swingable support 35.

The turntable 34 is arranged to rotate about a vertical shaft 53 which extends vertically through a central opening 54 formed in the center of the turntable. The vertical shaft 53 extends also vertically through the centers of said two support plates 36, 37 and is provided, at its lower end, with a cam follower 55 in the form of an inverted conical block which is normally in contact with the upper face of said control section 20 at a portion adjacent to said cam surface 25, 26. The lower and upper suport plates 36, 37 are securely fixed to the lower housing section 2 by means of vertically extending columns 56, 57. The vertical shaft 53 is adapted to be displaceable vertically with respect to the turntable 34 and support plates 36, 37. To the top end of the vertical shaft 53 one end of a flexible shaft B2 in the form of a coil spring, which extends longitudinally through the hollow supporting arm B1, is secured. Mounted on the upper portion of the vertical shaft 53 is a pinion 58 which is adapted to mesh with the crown gear 48 of the swingable support 35. This pinion 58 is normally located slightly below the crown gear 48 and disengaged therefrom. When the control section 20 is longitudinally displaced in the rightward direction as seen from the view in FIG. 6 by manipulation of the handle lever C1 of the control box C, the cam follower 55 is caused to ride onto the higher flat cam surface 26 by way of the inclined cam surface 25, thus causing the vertical shaft 53 to be upwardly displaced, so that the pinion 58 is raised with the vertical shaft and brought into meshed engagement with the crown gear 48. As the pinion 58 meshes with the crown gear 48 to rotate the latter, rotation of crown gear 48 is transmitted, through the intermediate gear 47 in engagement therewith, to said gear wheel 46 to rotate the supporting arm B1 whereby the aircraft B carried by the arm B1 is rotated about the axis thereof.

The electric motor 17 is connected to the lead wires 15, 16 within said lower housing section 2. As shown in FIG. 6, the motor 17 is securely mounted on the lower support plate 36 and is provided with an output pinion 17*a* which is in driving connection with a gear wheel 61 mounted on the vertical shaft 53 through the medium of intermediate gears 59, 60 so as to drive the vertical shaft 53 for rotation. Another pinion 62 is mounted on the vertical shaft 53, which is in driving connection with the inner gear 34*a* of the turntable 34 through the medium of intermediate gears 63, 64, 65 whereby when the vertical shaft 53 is rotated by the motor 17, its rotation is transmitted to the turntable 34.

The tubular cylinder 39 which is freely vertically displaceable is in contact, at its lower end, with the upper surface of the tip end portion of the L-shaped lever 27. When the second handle lever C2 of the control box C is manipulated to displace the tip end portion of the lever 27 in the upward direction, the tubular cylinder 39 is lifted thereby to push the lever 52 of swingable support 35 upwardly, thus causing the swingable support 35 to be swung upwardly about said horizontal axis with the supporting arm B1, whereby the aircraft B carried by the arm B1 is caused to be raised to the altitude corresponding to the amount of the upward angular movement of the supporting arm B1.

Figure 8:
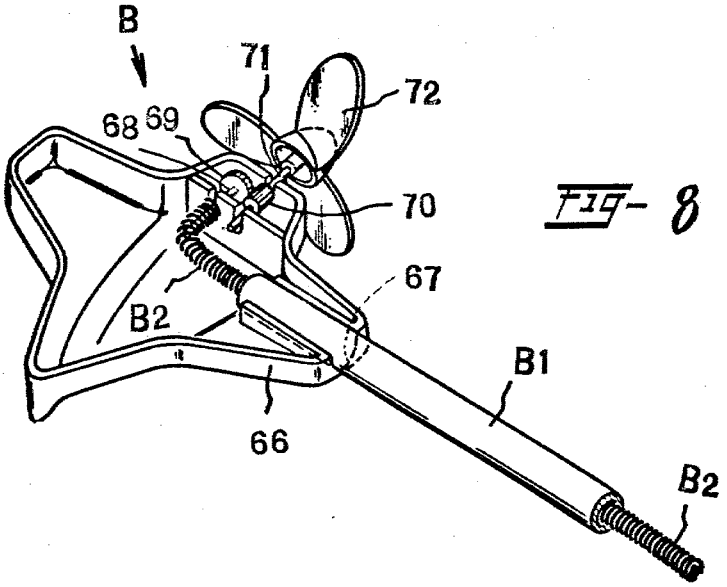
FIG. 8 is a perspective view illustrating the internal structure of an aircraft and the manner in which the aircraft is carried by a supporting arm.

FIG. 8 illustrates the internal structure of the aircraft B and the manner in which the aircraft is carried by the hollow supporting arm B1. As shown, this arm B1 is connected, at its tip end portion, to one of the main planes 66 of the aircraft B1 in such a way that it is resiliently fitted in a mating recess 67 formed in the plane. The flexible shaft B2 extending through the hollow supporting arm B1 is secured, at its extreme end, to the shaft 68 of a gear wheel 69 which is meshed with a pinion 70 which is mounted on the shaft 71 of the propeller 72 of aircraft B, thus making it possible to rotate the propeller 72. If a simulated helicopter, not shown, is mounted on the arm B1 in place of the aircraft, its rotor may be rotated in the same manner as mentioned above. In case a simulated bird, not shown, or the like is carried by the arm B1, it may be so constructed as to flap wings thereof. Also, the rotation of the flexible shaft B2 may be utilized for producing appropriate imitative sound.

Description will now be directed to the manner of operation of the toy of the present invention.

First, when the rotatable contact 9 which extends outwardly of the housing 1 is turned to "ON" position, the main switch S1 of the circuit for the dry cells 6 is turned on. Second, as the first handle lever C1 of the control box C is pushed towards the rotary structure A, the first rod 18 having the control section 20 is displaced in the opposite direction to cause the second switch S2 to be turned on in the manner aforementioned and to cause the apex of the V-shaped portion 12*a* of the second spring contact 12 to be engaged in the first notch 23 of the control section 20. As the switch S2 is turned on, the motor 17 starts rotating, causing rotation of the vertical shaft 53 and of the turntable 34 through the medium of the aforementioned gear 17*a*, 59 to 65, and 34*a*. When the turntable 34 is rotated, the swingable support 35 mounted thereon is rotated therewith to rotate the supporting arm B1 carried by the support 35, whereby the aircraft B1 supported by the support 35 is caused to make a circling flight around the rotary structure A. At the same time, the rotation of the vertical shaft 53 is transmitted to the propeller 72 of aircraft B1 via the flexible shaft B2 to rotate it.

Figure 2:
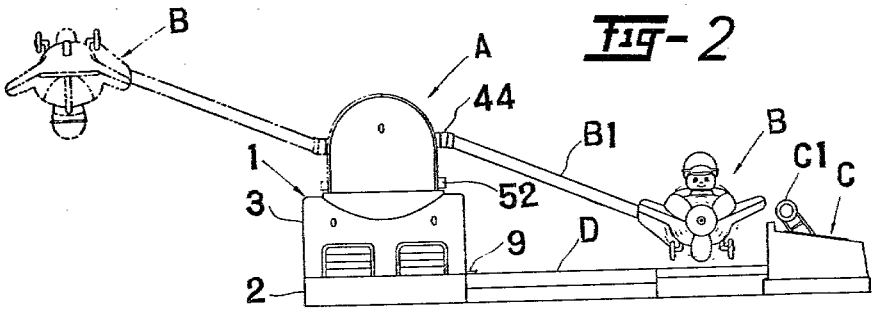
FIG. 2 is a side view of a variant of the embodiment shown in FIG. 1, illustrating the state in which a toy aircraft is making a loop-the-loop flight.

Then, as the first handle lever C1 is pushed further, the apex of the V-shaped portion 12*a* is brought into engagement with the second notch 24 of the control section 20, and, at the same time, the cam follower 55 is forced to ride onto the elevated horizontal cam surface 26 by way of the inclined cam surface 25 to lift the vertical shaft 53 so as to bring the upper pinion 58 thereof into engagement with the crown gear 48 of the swingable support 35. Thus, rotation of the vertical shaft 53 is transmitted to the supporting arm B1 in the manner aforementioned, so that the aircraft B is rotated with the supporting arm B1 to perform a loop-the-loop flight as shown in FIG. 2 while making a circling flight.

Next, as the second handle lever C2 of the control box C is manipulated in the manner previously described, the aircraft B is raised to a higher altitude, as aforementioned. FIG. 3 illustrates the state in which the aircraft B has been raised to nearly highest altitude. Then, as the second handle lever C2 is pulled back to its original position, the tubular cylinder 39 is lowered with the lifting lever 27 to cause the supporting arm B1, and accordingly, the aircraft B thereon to be lowered. Therefore, when the second handle lever C2 is repeatedly pushed and pulled, the aircraft B ascends and descends, repeatedly. Accordingly, when the second handle lever C2 is thus manipulated during the circling flight and/or the loop-the-loop flight of the aircraft B, it will repeatedly ascend and descend like a dive bomber.

What we claim is:

1. A device for driving a simulated flying object comprising a housing, an upwardly extending shaft mounted in said housing and extending outwardly from said housing in the upward direction, said shaft being displaceable in the axial direction thereof and movable relative to said housing, a rotary structure mounted on said housing and arranged to rotate around the axis of said shaft, said rotary structure comprising a turntable extending transversely of said shaft with said shaft extending through said turntable, a swingable support mounted on and extending upwardly from said turntable, said swingable support arranged to pivot about an axis extending transversely of said shaft, an elongated supporting arm secured at one end to said swingable support and extending outwardly thereform transversely of the axis of said shaft, said arm having an axis extending in the elongated direction thereof, said flying object being secured to the other end of said supporting arm spaced outwardly from said swingable support, an electric motor mounted in said housing, gear means driven by said electric motor for rotating said shaft for rotating said turntable around said shaft and for selectively rotating said support arm about the axis of said arm, means mounted on said housing for movement in the upward direction relative to said housing for engagement with said swingable support for pivoting said swingable support about the axis thereof so that said supporting arm secured thereto can be swung in an arc in an upwardly extending plane extending transversely of the pivot axis of said swingable support, manually operable control means for controlling the movement of said flying object comprising a first handle lever arranged to actuate said electric motor and for axially displacing said shaft for selectively engaging said gear means for rotating said support arm about the axis of said arm, and said gear means includes first gears for driving said shaft, second gears for rotating said turntable from said shaft and third gears for rotating said supporting arm from said shaft.

2. A device, s set forth in claim 1, wherein said manually operable control means comprises a first handle lever and a second handle lever each extending outwardly from said housing transversely of the axial direction of said shaft, said first handle lever being displaceable between a first position where said motor is in the switched-off position, a second position where said motor is in the switched-on position and a third position where said motor is in the switched-on position and said third gears are driven by said shaft for rotating said supporting arm, and said first handle lever including means for engaging said shaft within said housing for axially displacing said shaft in the upward direction.

3. A device, as set forth in claim 2, wherein said manually operable control means comprises a second handle lever extending outwardly from said housing in laterally spaced relation with said first handle lever, said means mounted on said housing for pivoting said swingable support comprises a cylinder encircling said shaft and spaced radially outwardly from said shaft, said cylinder being axially movable in the direction of said shaft from a first position where said cylinder is spaced below said swingable support to a second position where said cylinder engages said swingable support for pivoting said swingable support about the axis thereof, said second handle lever being displaceable for engagement with said cylinder for moving said cylinder from the first position to the second position in which second position said cylinder is axially displaceable in the direction of said shaft for moving said swingable support about the horizontal axis thereof.

4. A device, as set forth in claim 3, wherein said supporting arm comprises a tubular member, said tubular member having a first portion secured to said swingable support with the axis of said first portion extending approximately perpendicularly to the axis of said swingable support, and a second portion extending obliquely of said first portion, and said third gears including a gear wheel formed on the end of said first portion of said tubular structure spaced from said second portion so that said gear wheel is driven by said third gears for rotating said tubular structure around the axis thereof.

5. A device, as set forth in claim 4, wherein a flexible shaft extends through said tubular member from one end thereof to the other, one end of said flexible shaft extends from said first portion of said tubular member to the upper end of said shaft and is connected thereto, and the other end of said flexible shaft projects outwardly from the end of said second portion of said tubular member spaced outwardly from said first portion.

6. A device, as set forth in claim 5, wherein said flying object is a toy aircraft having a propeller mounted thereon, means for engaging the end of said flexible shaft extending outwardly from said second portion with said propeller for rotating said propeller.

7. A device, as set forth in claim 4, wherein said third gears include a pinion located on said shaft adjacent the upper end thereof, said pinion located above said turntable, a crown gear secured to said swingable support and being engageable with said pinion when said shaft is moved axially upwardly, an intermediate gear mounted on said swingable support and in engagement with said crown gear, said intermediate gear being in meshed engagement with said gear wheel on the end of said tubular member for rotating said tubular member about the axis thereof.

8. A device, as set forth in claim 1, wherein said first gears comprise an output pinion driven by said electric motor, a first intermediate gear driven by said output pinion, a shaft mounting said first intermediate gear, a second intermediate gear mounted on said shaft in spaced relation to said first intermediate gear, and a gear wheel mounted on said shaft and in meshed engagement with said second intermediate gear so that said first gears drive said shaft.

9. A device, as set forth in claim 8, wherein said second gears comprise a pinion mounted on said shaft in juxtaposition to said gear wheel driven by said first gears, a third intermediate gear in meshed engagement with said pinion, another shaft mounting said third intermediate gear, a fourth intermediate gear mounted on said another shaft in spaced relation to said third intermediate gear, a fifth intermediate gear mounted in parallel relation with said fourth intermediate gear and being in meshed engagement therewith, and an inner gear formed on said turntable and disposed in meshed engagement with said fifth intermediate gear for driving said turntable.

* * * * *